US005990010A

United States Patent [19]

Berman

[11] Patent Number: 5,990,010

[45] Date of Patent: Nov. 23, 1999

[54] PRE-CONDITIONING POLISHING PADS FOR CHEMICAL-MECHANICAL POLISHING

[75] Inventor: Michael J. Berman, West Linn, Oreg.

[73] Assignee: LSI Logic Corporation, Milpitas, Calif.

[21] Appl. No.: 08/841,947

[22] Filed: Apr. 8, 1997

[51] Int. Cl.[6] ..... H01L 21/302

[52] U.S. Cl. ..... 438/691; 438/692

[58] Field of Search ..... 438/690, 691, 438/692, 693

[56] References Cited

U.S. PATENT DOCUMENTS

| | | | |
|---|---|---|---|
| 5,081,051 | 1/1992 | Mattingly et al. | 437/10 |
| 5,216,843 | 6/1993 | Breivogel et al. | 51/131.1 |
| 5,527,424 | 6/1996 | Mullins | 156/636.1 |
| 5,536,202 | 7/1996 | Appel et al. | 451/285 |
| 5,547,417 | 8/1996 | Breivogel et al. | 451/58 |
| 5,595,527 | 1/1997 | Appel et al. | 451/28 |
| 5,665,201 | 9/1997 | Sahota | 438/693 |
| 5,692,947 | 12/1997 | Talieh et al. | 451/41 |

*Primary Examiner*—Benjamin Utech
*Assistant Examiner*—Kin-Chan Chen
*Attorney, Agent, or Firm*—Beyer & Weaver, LLP

[57] ABSTRACT

A preconditioning mechanism for preconditioning a polishing pad is described. The preconditioning mechanism includes an arm capable of being disposed over the polishing pad and a head section located on a distal end of the arm and rotatable about a central axis. Furthermore, the head section includes at least two heads oriented about the central axis and have surfaces for either conditioning or preconditioning the polishing pad, whereby rotation of the head section about the central axis by defined amounts presents at least two heads to the polishing pad so that different of the two heads can engage the polishing pad for conditioning or preconditioning depending upon how far rotation has proceeded.

3 Claims, 4 Drawing Sheets

PRE-CONDITIONING POLISHING PADS FOR CHEMICAL-MECHANICAL POLISHING

BACKGROUND OF THE INVENTION

The present invention relates to preconditioning of a polishing pad employed in chemical-mechanical polishing. More particularly, the present invention relates to in-situ, automatic preconditioning of a polishing pad employed in chemical-mechanical polishing.

Chemical-mechanical polishing (sometimes referred to as "CMP") typically involves mounting a wafer face down on a holder and rotating the wafer face against a polishing pad mounted on a pallet, which in turn is rotating or is in orbital state. A slurry containing a chemical that chemically interacts with the facing wafer layer and an abrasive that physically removes that layer is flowed between the wafer and the polishing pad or on the pad near the wafer. During IC fabrication, this technique is commonly applied to planarize various wafer layers, such as dielectric layers, metallization, etc. During CMP, the particles eroded from the wafer surface along with the abrasives in the slurry tend to glaze or accumulate over the polishing pad, reducing the polishing rate of the wafer surface and producing a non-uniformly polished wafer surface, e.g. the peripheral region of the wafer surface may not be polished to the same extent as the center region of the wafer surface. One way of achieving and maintaining a high and stable polishing rate is by conditioning the polishing pad every time after a wafer has been polished.

FIG. 1 shows part of a conventional chemical-mechanical polishing apparatus 10, which includes wafer cassettes 18, 20, 22, and 24, a robotic arm 16, a polishing pad 12 mounted on a rotating table or pallet 13, a conditioning arm 14, and a conditioning head 26. Cassettes 18, 20, 22, and 24 come equipped with various slots to store wafers of a production lot; such wafers are referred to herein as "production wafers." Slurry is delivered to polishing pad 12 by slurry inlet line 11. A wafer 15 held by a wafer holder 17 is rotatably driven against polishing pad 12 by a motor 19. Wafer holder 17 and motor 19 are positioned with respect to the polishing pad by an arm 21.

Depending on its size, polishing pad 12 may undergo conditioning either after the production wafer is polished or simultaneously while the production wafer is being polished. For convenience, FIG. 1 shows conditioning and polishing occurring simultaneously. Wafer polishing begins when robotic arm 16 takes a production wafer from one of cassettes 18, 20, 22, or 24 and provides that wafer, face down, to wafer holder 17. Motor 19 then rotates wafer 15 (via wafer holder 17) while a different motor rotates polishing pad 12 (via table 13). As wafer polishing proceeds, a slurry is delivered to pad 12 via inlet line 11.

At the appropriate time, conditioning arm 14 is lowered such that conditioning head 26 comes in contact with and engages rotating polishing pad 12. During pad conditioning, conditioning arm 14 pivots on one end, allowing the conditioning head to forcibly sweep back and forth across polishing pad 12 and generate grooves on the polishing pad. Although polishing pad 12 can be provided with grooves or perforations, the effectiveness of such grooves is reduced over time due to normal polishing. The conditioning pad thus serves to reintroduce the grooves or otherwise roughen the pad surface. It accomplishes this task with a jagged surface such as a wheel having diamond grit. Grooves produced during pad conditioning facilitate the polishing process by creating point contacts between the wafer surface and the pad, increase the pad roughness and allow more slurry to be applied to the substrate per unit area. Accordingly, the grooves generated on a polishing pad during conditioning increase and stabilize the wafer polishing rate.

U.S. Pat. No. 5,216,843 issued to Breivogel et al. describes a structure of one conditioning arm 14 and conditioning head 26. This patent is incorporated herein by reference in its entirety for all purposes.

Typically after polishing the last wafer in the last cassette, polishing pad 12 may sit idle for a period of time, e.g., anywhere from a few seconds to a few hours, before cassettes containing production wafers of a new production lot are queued up for polishing. Idle time may also result from a machine malfunction or routine maintenance. In order to prevent the polishing pad from drying up during the pad idle time, the polishing pad is maintained in a wet soak.

The first few production wafers from the new lot to undergo chemical-mechanical polishing on the polishing pad that has been idle for a period of time, may suffer from "a first-wafer effect." The first-wafer effect refers to a significant difference in polishing results, e.g., material removal rate and uniformity of material removal, obtained for the first wafer compared to that obtained for the subsequent production wafers. It is believed that the significant difference in the polishing results obtained for the first wafer compared to the subsequent production wafers is attributed to the different polishing conditions encountered by the first wafer. Possibly this results from a non-equilibrium situation in which the concentration of the particular material removed from the wafer surface increases during polishing of the first wafer. Once the first few wafers are completely polished, the pad may have a steady concentration of such material. Thus, the polishing conditions stabilize after the first few wafers are polished.

In the wafer fabrication industry, it is common practice to set the chemical-mechanical polishing conditions for the subsequent production wafers based on the results obtained for the first production wafer. Therefore, when the polishing results obtained for the first production wafer vary significantly from that of the subsequent production wafers under the same polishing conditions, the polishing conditions set for the subsequent production wafers may strongly deviate from optimal conditions.

To mitigate the problems of the first wafer effect, blank "preconditioning wafers" may be contacted with a rotating polishing pad. The preconditioning wafers should have a coating of the same or a similar material as that which will undergo polishing on the production wafer surface. After preconditioning with such wafers for a certain length of time, the first production wafer is installed in the wafer holder and polished. Because the preconditioning wafer has "preconditioned" the pad, the first wafer effect is reduced or eliminated. This preconditioning procedure is currently implemented in a somewhat cumbersome manner. For example, a worker in the fabrication facility may first transport a cassette containing preconditioning wafers from a remote location to the polishing apparatus, where the preconditioning wafers then undergo chemical-mechanical polishing to precondition the polishing pad. Further, about 3 or 4 preconditioning wafers may be required before the polishing pad is effectively preconditioned to reduce the first-wafer effect.

As should be apparent, the current pad conditioning process suffers from several draw backs. For example, the pad preconditioning process described above is a time-consuming and arduous task. It requires transporting the preconditioning wafers to the CMP apparatus, occupying valuable space in wafer cassettes with these wafers, and installing these wafers. All this is done while a new lot of production wafers must wait to undergo polishing. Furthermore, the preconditioning wafers must be periodically evaluated, reworked or redeposited with the appropriate coating to maintain effective pad preconditioning. This translates into reduced throughput for the polishing process. The maintenance of the preconditioning wafers can also be an expensive proposition.

What is therefore needed is an improved apparatus and process of preconditioning a polishing pad to avoid the labor intensive steps of the current process and provide a higher throughput at reduced cost.

SUMMARY OF THE INVENTION

To achieve the foregoing, the present invention provides a preconditioning mechanism for preconditioning a polishing pad. The preconditioning mechanism includes an arm capable of being disposed over the polishing pad and a head section located on a distal end of the arm and rotatable about a central axis. Furthermore, the head section includes at least two heads oriented about the central axis and have surfaces for either conditioning or preconditioning the polishing pad, whereby rotation of the head section about the central axis by defined amounts presents at least two heads to the polishing pad so that different of the two heads can engage the polishing pad for conditioning or preconditioning depending upon how far rotation has proceeded.

The head section of the above described mechanism may rotate about the central axis, however, when one of the heads is repositioned to contact the polishing pad, the arm does not rotate. At least one of the heads may include a preconditioning material selected from the group consisting of quartz, tungsten, copper and aluminum and a conditioning material selected from the group consisting of a diamond grid or a nylon brush. Alternatively, the head section may include at least one conditioning head and at least two preconditioning heads, each having a different preconditioning material. The preconditioning material may be substantially round.

The mechanism described above, may further include a controller for controlling rotation of the head section. The mechanism described above, may further still include a pivoting connection at the proximal end of the arm such that the arm is capable of pivoting in a manner allowing the head section to sweep across the polishing pad. The pivoting connection may be coupled to an oscillating motor such that the head section can sweep across the polishing pad.

In another aspect, the present invention provides a preconditioning assembly for conditioning or preconditioning a polishing pad. The preconditioning assembly includes a polishing pad mounted on a pallet, a wafer holder for holding a production wafer in contact with the polishing pad, and the preconditioning mechanism described above. The preconditioning assembly may further include a control system for controlling one or more operations selected from the group consisting of rotating the pallet, directing the wafer holder onto the polishing pad, and controlling pivoting and rotation of the preconditioning mechanism. The polishing pad may include polyurethane and may be part of a chemical-mechanical polishing apparatus.

In yet another aspect, the present invention provides a preconditioning assembly for conditioning or preconditioning a polishing pad. The preconditioning assembly for conditioning or preconditioning a polishing pad includes a conditioning mechanism and a preconditioning mechanism. The conditioning mechanism includes (i) a conditioning arm capable of being disposed over the polishing pad and (ii) a conditioning head section located at a distal end of the conditioning arm and having a conditioning material capable of effectively conditioning the polishing pad. The preconditioning mechanism includes (iii) a preconditioning arm capable of being disposed over the polishing pad and (iv) a preconditioning head section located at a distal end of the preconditioning arm, the preconditioning head section having at least one preconditioning film capable of effectively preconditioning the polishing pad.

The preconditioning head may be rotatable about a central axis and may include at least two preconditioning heads, whereby rotation of the preconditioning head about the central axis by defined amounts presents the at least two preconditioning heads to the polishing pad so that different of the at least two preconditioning heads can engage the polishing pad for preconditioning depending upon the how far rotation has proceeded. The preconditioning head section may rotate about the central axis, however, when one of the heads is repositioned to contact the polishing pad, the preconditioning arm does not rotate. The preconditioning film may include a material selected from the group consisting of quartz, tungsten, copper and aluminum. The preconditioning film may have a thickness of between about 20 to about 30 mils and may be substantially round. The conditioning material may be selected from the group consisting of a diamond grid or a nylon brush. The preconditioning assembly may further include a polishing pad mounted on a pallet.

In yet another embodiment, the present invention provides an automated pad preconditioning process performed with the aid of control systems. The automated pad preconditioning process includes determining that a wafer is ready for polishing, determining whether a polishing pad has been idle for at least a predetermined period and when the polishing pad has been idle for at least the predetermined period, automatically preconditioning the pad. The automated pad preconditioning process may further include polishing the wafer after preconditioning the pad. The automated pad preconditioning process may further still include conditioning the polishing pad after the wafer has been polished. The preconditioning step may be performed by directing a preconditioning head mounted on an arm onto the polishing pad, and wherein the conditioning is performed by directing a conditioning head mounted on the same arm onto the polishing pad. Before the conditioning step, the arm may be rotated about an axis so that the preconditioning head is moved away from the polishing pad and the conditioning head is moved toward and facing the polishing pad. The step of preconditioning of the pad is performed for a period of time that varies with the length of time that the polishing pad has been idle.

In yet another aspect, the present invention provides another preconditioning mechanism for preconditioning a polishing pad. The preconditioning mechanism includes means for holding multiple heads capable of being disposed over the polishing pad and means for preconditioning or conditioning located on a distal end of the means for holding multiple heads and rotatable about a central axis. The means for preconditioning or conditioning further includes at least two heads oriented about the central axis and having surfaces for either conditioning or preconditioning the polishing pad, whereby rotation of the means for preconditioning or conditioning about the central axis by defined amounts presents the at least two heads to the polishing pad so that different of the at least two heads can engage the polishing pad for conditioning or preconditioning depending upon how far rotation has proceeded.

The means for holding multiple heads may include an arm and the means for preconditioning or conditioning may include a head section on the means for holding multiple heads. At least one of the means for preconditioning or conditioning may include a preconditioning material selected from the group consisting of quartz, tungsten, copper and aluminum and a conditioning material selected from the group consisting of a diamond grid or a nylon brush. The preconditioning mechanism may further include a controller for controlling rotation of the means for preconditioning or conditioning. At least one of the heads may be a preconditioning head and may be substantially round. The preconditioning mechanism may further include a pivoting connection at the proximal end of the means for holding multiple heads such that the means for holding multiple heads is capable of pivoting in a manner allowing the means for preconditioning or conditioning to sweep across the polishing pad. The pivoting connection may be coupled to an oscillating motor such that the means for preconditioning or conditioning can sweep across the polishing pad.

The present invention represents a marked improvement over the current apparatuses and methods for pad preconditioning. For example, the preconditioning assemblies of the present invention are in-situ assemblies that eliminate the time-consuming step of a fabrication facility worker transporting preconditioning wafers from a remote location to the polishing apparatus. As a further example, embodiments of the preconditioning assemblies shown in FIGS. 2 and 3 eliminate the cumbersome task of separately storing and transporting preconditioning wafers as described above and offer the flexibility of multiple heads on the same preconditioning arm. This translates into a higher throughput of the IC substrate. It is also important to note that the preconditioning assemblies of the present invention can be incorporated into the current conditioning and polishing apparatus with minor modifications. All these factors reduce the cost of implementing pad preconditioning according to the present invention.

These and other features of the present invention will be described in more detail below in the detailed description of the invention and in conjunction with the following figures.

DETAILED DESCRIPTION OF THE PREFERRED EMBODIMENTS

The present invention provides preconditioning assemblies for in-situ, automated preconditioning processes of polishing pads employed in chemical-mechanical polishing. In the following description, numerous specific details are set forth in order to fully illustrate a preferred embodiment of the present invention. It will be apparent, however, that the present invention may be practiced without limitation to some specific details presented herein.

Figure 2A:
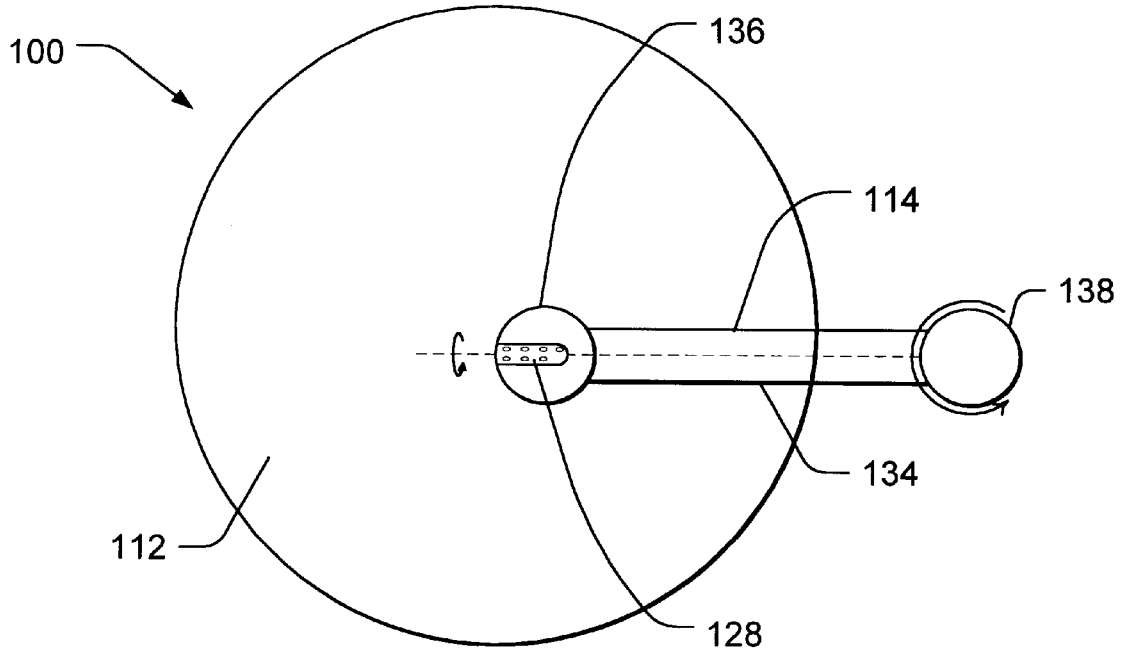
FIG. 2A is a top view of a preconditioning assembly, according to one embodiment of the present invention, including a preconditioning arm having multiple heads, which can effectively condition and precondition the polishing pad.
Figure 2B:
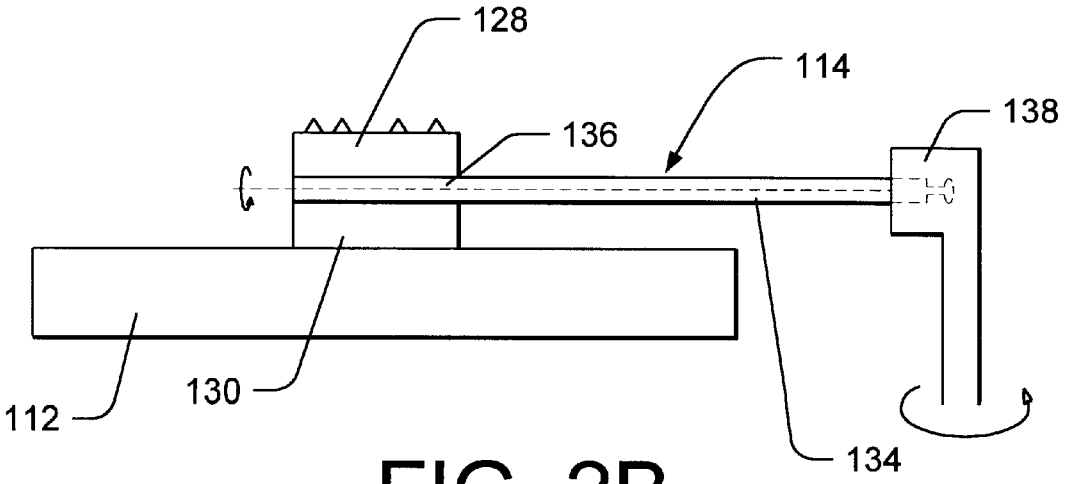
FIG. 2B is a side view of the preconditioning arm of FIG. 3.

FIG. 2A shows a top view and FIG. 2B shows a side view of preconditioning assembly 100, according to one embodiment of the present invention. Assembly 100 includes a preconditioning mechanism 114 positioned over a polishing pad 112. Polishing pad 112 may be mounted on a pallet (not shown), which supports and rotates the pad under operation. Preconditioning mechanism 114 includes an arm 134 having a head section 136, which includes two heads 128 and 130, and a pivoting connection 138. Connection 138 allows arm 134 to sweep over the surface of pad 112 so that heads 130 and 128 can reach all portions of 112. As shown in FIG. 2B, head 130 is attached to the bottom of head section 136 and positioned to contact polishing pad 112.

As shown in FIGS. 2A and 2B, head section 136 is located at a distal end of preconditioning mechanism 114 and pivoting connection 138 is located at a proximal end of mechanism 114. Preferably one of the heads, head 128 for example, is a conditioning head having a diamond grit surface or other appropriate conditioning surface. The other head, head 130, is preferably a preconditioning head or wafer. Thus, in this embodiment, the same preconditioning arm includes a conditioning head and a preconditioning head. Of course, it may be sometimes be preferable to have more than one preconditioning head, each containing a different surface material (e.g., aluminum, quartz, tungsten, or polysilicon). This flexibly allows preconditioning before CMP of different types of IC layers.

In the embodiment shown in FIGS. 2A and 2B, either of heads 128 and 130 in head section 136 can engage polishing pad 112 to condition or precondition the polishing pad as desired. One skilled in the art might appreciate that there are a number of designs that would allow any one of two or more heads to engage with polishing pad 112. Generally, the design should allow the head section to rotate between positions separated by 180°. If more than two heads are employed, the head section must be able to rotate in increments of 360°/n, where "n" is the number of heads provided on the arm. In one embodiment, arm 134 rotates about its longitudinal axis arm such that any one of its heads are positioned to engage with the polishing pad. Such rotation can be controlled at pivoting connection 138. Alternatively, in another embodiment, only the head section 136 rotates about the longitudinal axis of arm 134. With an appropriate control system, either of heads 128 and 130 can be turned face down to engage with polishing pad 112 and effectively condition or precondition the polishing pad. Suitable control systems are readily available or can be readily programmed to provide automated control over rotation.

As noted, preconditioning arm 134 can pivot about pivoting point 138 so that head section 136 can sweep across polishing pad 112 to condition or precondition the polishing pad. One skilled in the art might appreciate that there are a number of ways to control pivoting of arm 134 about pivoting connection 138. By way of example, an oscillating motor (not shown) coupled to connection 138 may sweep head section 136 back and forth across pad 112.

A pad preconditioning process employing a multihead preconditioning arm of this invention (such as that shown in FIGS. 2A and 2B) may be carried out by first rotating head section 136 about the central axis (by any appropriate mechanism) such that either a conditioning or preconditioning head is positioned face down above polishing pad 112. Next, the polishing pad 112 begins to rotate. Head section 136 is then lowered onto polishing pad 112, allowing the preconditioning or conditioning head to contact rotating polishing pad 112. At this point, arm 114 pivots at pivoting connection 138 to sweep head section 136 across polishing pad 112 and effectively condition or precondition the polishing pad. One skilled in the art can appreciate that the present invention is not limited to the above described sequence of steps. By way of example, it is possible that the polishing pad begins rotation only after the preconditioning or conditioning head is already in engagement with the polishing pad.

Preconditioning arm 114 may be made from any rigid material, such as stainless steel or a ceramic. Polishing pad 112 may be any conventional polishing pad employed in the art. Generally, suitable pads are made from a material capable of withstanding the physically and chemically harsh environment of CMP. In one example, polishing pads made from a hard polyurethane material are suitable. Conditioning material mounted on head 128 in the embodiment shown in FIGS. 2A and 2B, for example, may include a diamond grid or a nylon brush. Preconditioning films mounted on head 130 may include quartz and such materials as tungsten, aluminum, or copper. The preconditioning film and conditioning material are preferably substantially round (e.g., circular), so that erosion particles do not become trapped in any sharp corners. Both the preconditioning and conditioning heads can be shaped, sized and otherwise designed very similar to preconditioning and conditioning heads now in existence. The only modifications that may be necessary are those that will allow them to mount to head region 136.

The preconditioning film has a thickness that is between about 20 and about 30 mils. The conditioning diamond grid can be a fine mesh of the same thickness as a wafer that is between about 20 and about 30 mils thick or it can be a big thick disk on the order of a few inches. A nylon brush is between about 1 and about 2 inches thick.

As in the prior art, the preconditioning film preferably includes the same metal that is deposited on the IC substrate surface that undergoes polishing. By way of example, if the IC substrate surface that is being polished includes tungsten, then pad preconditioning is preferably carried out using a preconditioning film of tungsten. If, however, a deposition of silicon dioxide on the IC substrate surface is being polished, then it is preferable to condition the polishing pad by using a preconditioning film of quartz.

When multiple preconditioning heads are employed on a rotatable head, each one of these heads should have a different preconditioning film, e.g., quartz, tungsten, copper or aluminum, depending on the application of the polishing pad. Thus, in order to switch from pad conditioning to pad preconditioning or switch from conditioning a polishing pad that is employed for polishing one metal on the IC substrate surface to conditioning another polishing pad that is employed for polishing another metal on the IC substrate surface, a potential user simply rotates either a portion of the arm section or the head section of the preconditioning arm such that the appropriate conditioning or preconditioning head are in position to engage the polishing pad. Pad preconditioning or conditioning is then carried out as described above.

Figure 3A:
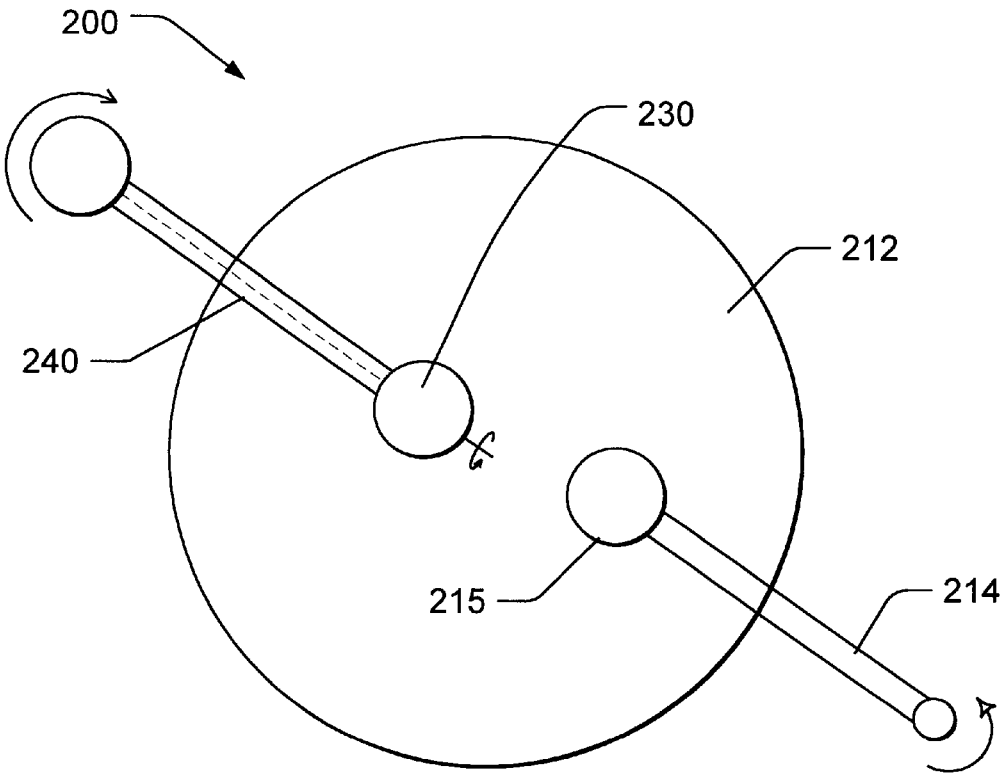
FIG. 3A is a top view of a conditioning and preconditioning assembly, according to another embodiment of the present invention, including a conditioning arm and a preconditioning arm positioned above a polishing pad.

FIGS. 3A (top view) and 3B (side sectional view) show a conditioning and preconditioning assembly 200, according to another embodiment of the present invention. In this embodiment, preconditioning assembly 200 includes two separate arms, a preconditioning arm 240 and a conditioning arm 214, positioned above a polishing pad 212. Conditioning arm 214 is substantially similar to a conventional conditioning arm described in FIG. 1 and includes a conditioning head 215 having a diamond or other conditioning surface. Preconditioning arm 240 includes preconditioning films 228 (not shown in FIG. 2A), 230 and is substantially similar to the preconditioning arm described in FIGS. 2A and 2B, except that none of the heads include a conditioning material as it is provided on separate conditioning arm 214. In other words, preconditioning arm 240 does not include a conditioning head. Preconditioning arm 240 functions in a manner that is substantially similar to the preconditioning arm mechanism 114 in the embodiment of FIGS. 2A and 2B. It must be able to rotate about a longitudinal axis to present each of its preconditioning heads to the surface of polishing pad 212. In contrast, conditioning arm 214 need not be rotatable. Of course, to further increase the system's flexibility, arm 214 could be outfitted with a preconditioning head in addition to its conditioning head 215. This would provide the system with at least three preconditioning heads (two on arm 214 and one on arm 240). Further, either or both of arms 214 and 240 could be outfitted with three or more heads to provide even more options for preconditioning.

As mentioned, one difficulty in current CMP systems is reduced throughput resulting from system downtime required for preconditioning and sometimes conditioning. The present invention addresses this difficulty by providing an automated system and method for performing conditioning and preconditioning. Preferably, though not necessarily, the automated system employs a multiheaded arm as described above.

Figure 4:
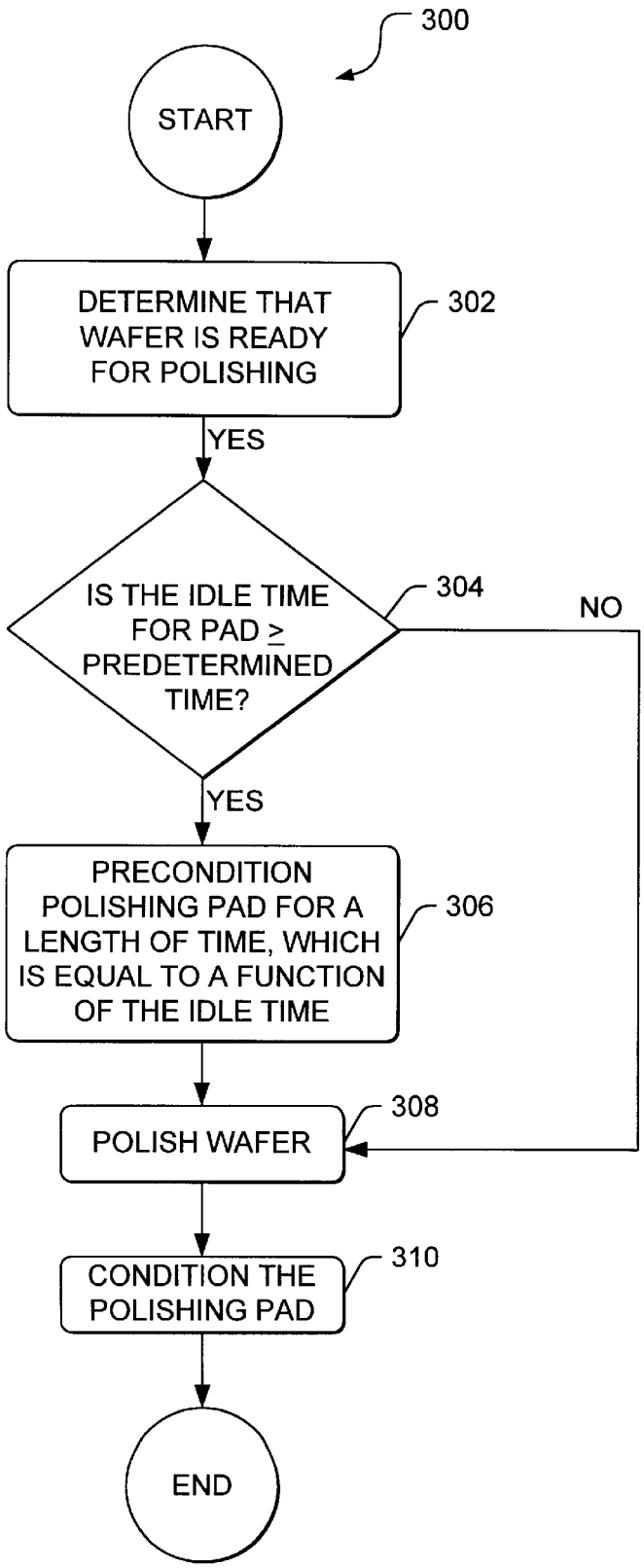
FIG. 4 is a flow chart of one embodiment of an inventive automated process that incorporates preconditioning of a polishing pad into a chemi-mechanical process.

FIG. 4 is a flow chart of one embodiment of an inventive process 300 that automates the process of preconditioning a polishing pad into chemical-mechanical polishing. The process begins at a step 302, where the automated CMP system determines that a wafer is ready to undergo polishing. This may occur when the system presents a new production wafer or comes on line to continue polishing of a wafer surface that has been partially polished. If the wafer is not ready for polishing, then the polishing apparatus sits idle. Preferably, the system monitors the length of the idle time.

When step 302 indicates that a wafer is ready for polishing, then in a step 304, it is determined whether the "idle time" of the polishing pad is greater than or equal to a "predetermined time." The term "idle time" as used herein generally refers to the length of time that the polishing pad has been idle from polishing a wafer surface. The term "predetermined time" as used herein refers to a preset length of idle time that has been determined to cause a first-wafer effect. If the pad sits idle for longer than the predetermined time, it can be expected that the first wafer effect will be sufficiently pronounced that corrective action should be performed. If the pad sits idle for no more than the predetermined time, it should only minimally exhibit the first wafer effect. The predetermined time generally varies depending on the type of polishing pad, the polishing application of the polishing pad, e.g. whether the polishing pad is polishing a wafer surface with tungsten deposition or silicon dioxide deposition, etc. The predetermined time may generally be greater than or equal to one minute.

If the idle time of the polishing pad is not greater than or equal to the predetermined time, then no preconditioning of the polishing pad is necessary and process 300 proceeds to a step 308 where chemical-mechanical polishing of the wafer is carried out. If, however, it is determined that the idle time of the polishing pad is greater than or equal to the predetermined time, then preconditioning of the polishing pad is carried out in a step 306 for a length of time referred to herein as "preconditioning time." Preconditioning of the polishing pad may be carried out in any number of ways, including the various preconditioning assemblies of the present invention described above.

In step 306, in one embodiment of the present invention, preconditioning time is a function of idle time. In other words, the polishing pad undergoes preconditioning for a length of time that depends on how long the pad has been idle from polishing a wafer. By way of example, if the polishing pad has been idle for about 2 to about 5 minutes, pad preconditioning time may be about 1 minute, if the pad has been idle for about 5 to about 10 minutes, the pad preconditioning time may be about 2 minutes, if the pad has been idle for about 10 to about 30 minutes, the pad preconditioning time may be about 4 minutes and if the pad has been idle for more than 30 minutes, the preconditioning time may be about 6 minutes. It should be borne in mind, however, that these values for preconditioning time and idle time are for exemplary purposes only and are not intended to limit the present invention in any way.

As noted, the wafer undergoes polishing at step 308. When this process is completed, the polishing pad undergoes pad conditioning with a conditioning head as described above. In one embodiment, where the polishing pad employed in the present invention is large enough, steps 308 and 310 may be carried out simultaneously, i.e. the pad is being conditioned and being used for chemical-mechanical polishing at the same time. Pad conditioning may be carried out using the preconditioning assemblies of the present invention which are flexible enough to precondition and condition the polishing pad.

Generally, the systems of this invention will include a controller for controlling some or all of the following functions: rotating the pallet, directing the wafer holder onto the polishing pad, and controlling pivoting and rotation of the preconditioning mechanism. In the embodiment of FIGS. 2A and 2B, the preconditioning may be performed for a period of time set by the controller. During this process, head 130 on arm mechanism 114 contacts a rotating pad 112. Then, when preconditioning is complete, a production wafer is oriented for polishing and arm 114 is rotated by 180° to present conditioning head 128. Finally, both the wafer and the conditioning head 128 are directed onto rotating pad 112.

Figure 3B:
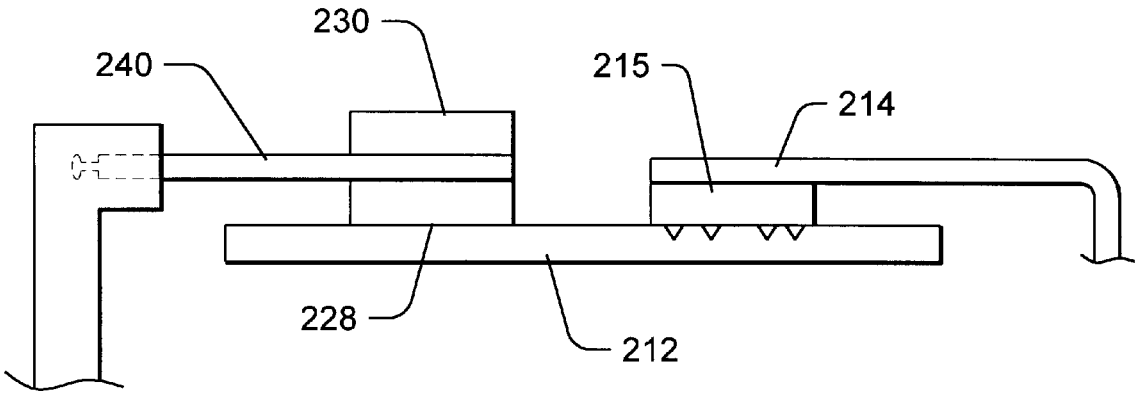
FIG. 3B is a side sectional view of the conditioning and preconditioning assembly of FIG. 3A.

The present invention represents a marked improvement over the current apparatuses and methods for pad preconditioning. For example, the preconditioning assemblies of the present invention are in-situ assemblies that eliminate the time-consuming step of a fabrication facility worker transporting preconditioning wafers from a remote location to the polishing apparatus. As a further example, embodiments of the preconditioning assemblies shown in FIGS. 2 and 3 eliminate the cumbersome task of separately storing and transporting preconditioning wafers as described above and offer the flexibility of multiple heads on the same preconditioning arm. This translates into a higher throughput of the IC substrate. It is also important to note that the preconditioning assemblies of the present invention can be incorporated into the current conditioning and polishing apparatus with minor modifications. All these factors reduce the cost of implementing pad preconditioning according to the present invention.

Figure 1:
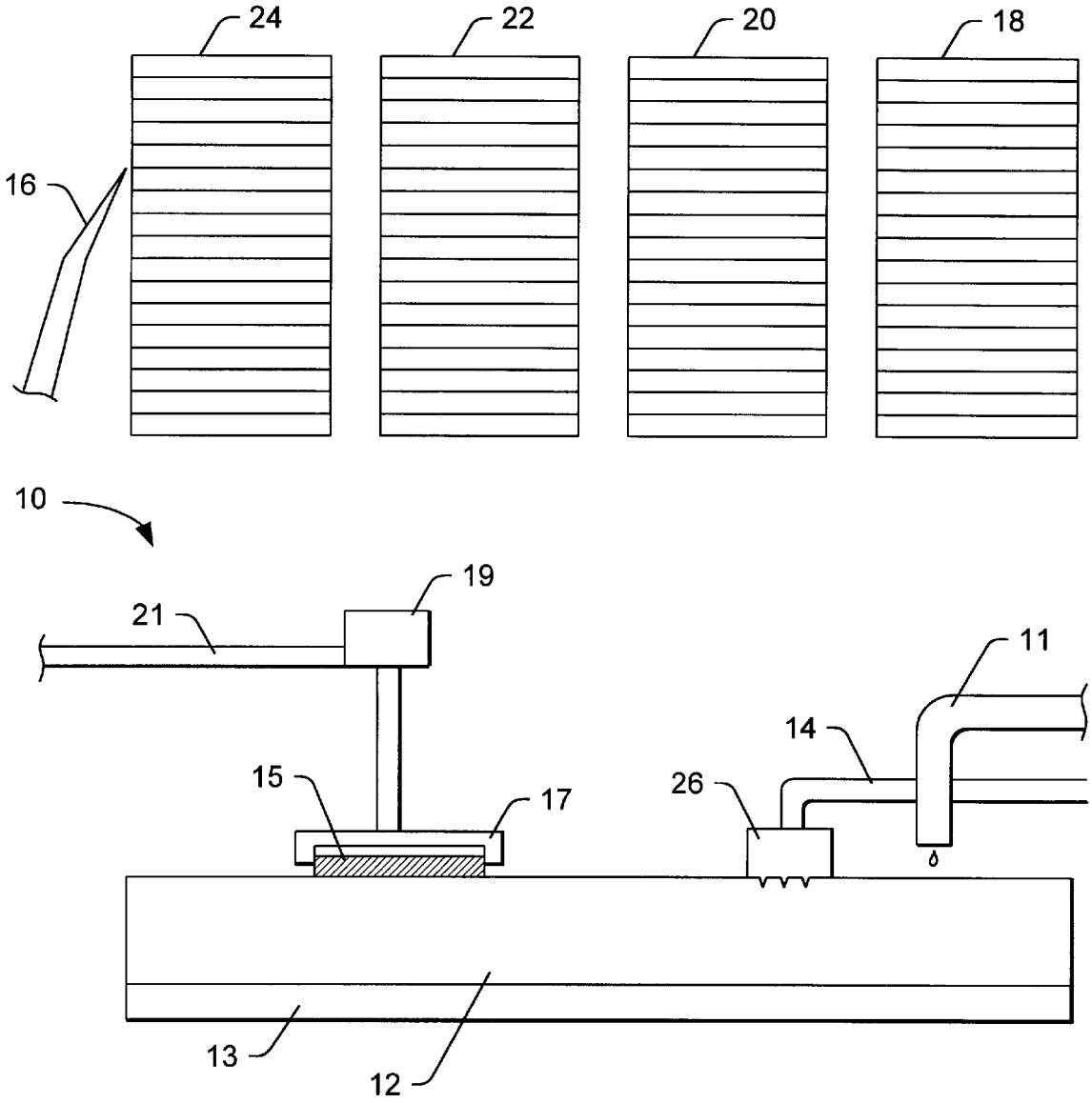
FIG. 1 shows a conventional polishing apparatus including a conditioning arm mounted with a conditioning head and wafer cassettes for holding production wafers, which are transported from the cassettes to a polishing pad by a robotic arm.

For example, the above-described method can be applied to a preconditioning assembly is similar to the conditioning apparatus described in FIG. 1. In such systems, at least one of the cassettes (i.e. cassettes 18, 20, 22 and 24 of FIG. 1) is dedicated to holding preconditioning wafers. According to this inventive method, however, when preconditioning is deemed necessary, a robotic arm similar to the one described in FIG. 1 automatically removes a preconditioning wafer from the cassette and delivers it to the polishing pad. Thereafter, the preconditioning wafer then undergoes chemical-mechanical polishing. Preconditioning is controlled by an algorithm similar to that presented above. With regard to maintenance of the preconditioning wafers in the cassette or on an arm, software may be employed to keep track of how much the preconditioning wafers are being used and then accordingly alert a worker to redeposit or perform other rework on the preconditioning wafers.

When the automated methods of the present invention are employed in a conventional CMP system, cassettes may be employed to hold preconditioning wafers. Such cassettes should be wide enough to hold a 6", 8" or 12" preconditioning wafer and long enough to store a sufficient number of wafers (e.g., about 25) in different slots. Suitable cassettes are commercially available from various suppliers. By way of example, such cassettes come as a part of IPEC 776 Wafer Polishing System, which is commercially available from International Process Equipment Corporation of Phoenix, Ariz.

Suitable computer systems for use in implementing and controlling the automated methods of the present invention may be obtained from various vendors. In one preferred embodiment, an appropriately programmed HP735 workstation (Hewlett Packard, Palo Alto, Calif.) or Sun ULTRASPARC or Sun SPARC (Sun Microsystems, Sunnyvale, Calif.) may be employed in an IBM PC based system or a VM buss controller.

It should be understood that the present invention also relates to machine readable media on which are stored instructions for implementing the invention. Such instructions may provide appropriate values for obtaining the predetermined idle time, the preconditioning time based on idle time, etc. Such media includes, by way of example, magnetic disks, magnetic tape, optically readable media such as CD ROMs, semiconductor memory such as PCMCIA cards, etc. In each case, the medium may take the form of a portable item such as a small disk, diskette, cassette, etc., or it may take the form of a relatively larger or immobile item such as a hard disk drive or RAM provided in a computer.

Although the foregoing invention has been described in some detail for purposes of clarity of understanding, it will be apparent that certain changes and modifications may be practiced within the scope of the appended claims. For example, while the specification has described the pad preconditioning processes and apparatuses to be used in the context of chemical-mechanical polishing, there is no reason why in principle such pad preconditioning processes and apparatuses could not be used to precondition a polishing pad used in other polishing applications. Therefore, the present embodiments are to be considered as illustrative and not restrictive, and the invention is not to be limited to the details given herein, but may be modified within the scope of the appended claims.

What is claimed is:

1. An automated pad preconditioning process performed with the aid of a control system, the process comprising:

determining that a wafer is ready for polishing;

determining whether a polishing pad has been idle for at least a time;

when the polishing pad has been idle for at least said time, automatically preconditioning the pad;

polishing said wafer after preconditioning the pad; and conditioning the polishing pad after the wafer has been polished, wherein the preconditioning is performed by directing a preconditioning head mounted on an arm onto the polishing pad, and wherein the conditioning is performed by directing a conditioning head mounted on the same arm onto said polishing pad.

2. The process of claim 1, wherein prior to said conditioning, the arm is rotated about an axis so that the preconditioning head is moved away from said polishing pad and the conditioning head is moved toward and facing said polishing pad.

3. A method of affecting the polishing performance of a polishing pad used in chemical mechanical polishing, the method comprising:

preconditioning the polishing pad by directing a preconditioning head mounted on a arm onto the polishing pad;

conditioning the polishing pad by directing a conditioning head mounted on said arm onto the polishing pad; and polishing one or more wafers with the polishing pad prior to said conditioning but after said preconditioning, wherein prior to said conditioning, the arm is rotated about an axis so that the preconditioning head is moved away from said polishing pad and the conditioning head is moved toward and facing said polishing pad.

* * * * *